United States Patent [19]

Hultgren et al.

[11] 4,065,999

[45] Jan. 3, 1978

[54] MAGAZINE FOR TANK

[75] Inventors: Karl Sten Rudolf Hultgren; Sven-Håkan Svensson, both of Karlskoga, Sweden

[73] Assignee: AB Bofors, Bofors, Sweden

[21] Appl. No.: 616,706

[22] Filed: Sept. 25, 1975

[30] Foreign Application Priority Data

Oct. 18, 1974 Sweden ..... 7413125

[51] Int. Cl.[2] ..... F41H 7/06

[52] U.S. Cl. ..... 89/36 H; 89/38; 89/45; 89/47

[58] Field of Search ..... 89/33 A, 33 B, 36 H, 89/36 K, 37.5 D, 38, 39, 40 B, 45, 46, 47, 34

[56] References Cited

U.S. PATENT DOCUMENTS

| | | | |
|---|---|---|---|
| 1,170,577 | 2/1916 | Strauss et al. | 89/38 |
| 2,690,700 | 10/1954 | Turner | 89/36 H |
| 2,933,981 | 4/1960 | Anderson et al. | 89/36 H |
| 3,238,845 | 3/1966 | Christiansson | 89/46 |
| 3,762,268 | 10/1973 | Gaye | 89/34 |

FOREIGN PATENT DOCUMENTS

| | | | |
|---|---|---|---|
| 1,428,746 | 10/1973 | Germany | 89/40 B |
| 2,149,954 | 4/1973 | Germany | 89/40 B |

*Primary Examiner*—Stephen C. Bentley
*Attorney, Agent, or Firm*—Pollock, Vande Sande & Priddy

[57] ABSTRACT

A tank supporting a large-caliber firearm which can be raised and lowered relative to the tank chassis. A first magazine is hingedly connected to the firearm at its rear end, and a second magazine is hingedly connected to the tank chassis. When the barrel of the firearm is in its zero traverse position and in its lowermost position relative to the tank chassis, the first and second magazines are interconnected and a hoisting apparatus lifts successive rounds of ammunition from the second magazine to the first magazine, and the rounds are then rammed into the barrel of the firearm.

9 Claims, 6 Drawing Figures

MAGAZINE FOR TANK

BACKGROUND OF THE INVENTION

The present invention relates to a magazine for a tank equipped with a large-calibre firearm arranged so that it can be raised and lowered in relation to the tank chassis.

For tanks of the kind in question, there is a desire that at least most of the ammunition carried along can be given a low position in the tank so that a low silhouette can be maintained for it when the gun is lowered.

SUMMARY OF THE INVENTION

According to the invention, it is proposed that the magazine in question should be divided up into a first magazine portion connected to the firearm and a second magazine portion connected to the tank chassis, the first magazine portion then consisting of a small magazine for comparatively few rounds. The magazine portions are then made so that they can be joined together in a certain position of the gun, for instance when this is completely lowered and given the traversing position of zero in relation to the tank chassis.

In a further development of the concept of the invention it is also proposed that the first magazine portion should be connected articulately to the firearm and that the second magazine portion should be connected articulately to the tank chassis so that the magazine portion can be folded up when colliding with the ground, when the collapsible flotation screen of the tank is to be utilized. In a still further development, the two magazine portions are placed farthest to the rear of the tank, the second magazine portion then consisting of a member separated from the other parts of the tank chassis, which is suspended entirely to the rear of the tank in special fastening members.

The feature that can mainly be considered to be characteristic for the magazine according to the invention is that it comprises a first magazine portion connected to the firearm which can be raised and lowered and a second magazine portion connected to the tank chassis and that the magazine portions can be joined together in a given position of the firearm in order to provide for automatic transfer of rounds from the second magazine portion to the first magazine portion.

BRIEF DESCRIPTION OF THE DRAWINGS

Several embodiments of the invention will be described in the following, with reference to the attached drawings, in which FIG. 1 in a vertical view shows a first embodiment of a tank utilizing the new magazine, FIG. 2 in a horizontal view shows the tank according to FIG. 1, FIG. 3 in a vertical view shows parts of a tank utilizing a second embodiment of the new magazine, FIG. 4 in a horizontal view shows the parts of the tank according to FIG. 3, FIG. 5 in an end view shows devices for raising and lowering the gun in relation to the tank chassis, and FIG. 6 in an end view shows the interior of the new magazine.

In the figures, parts corresponding to each other have been given the same reference designations.

DETAILED DESCRIPTION OF THE PREFERRED EMBODIMENT

Figure 1:
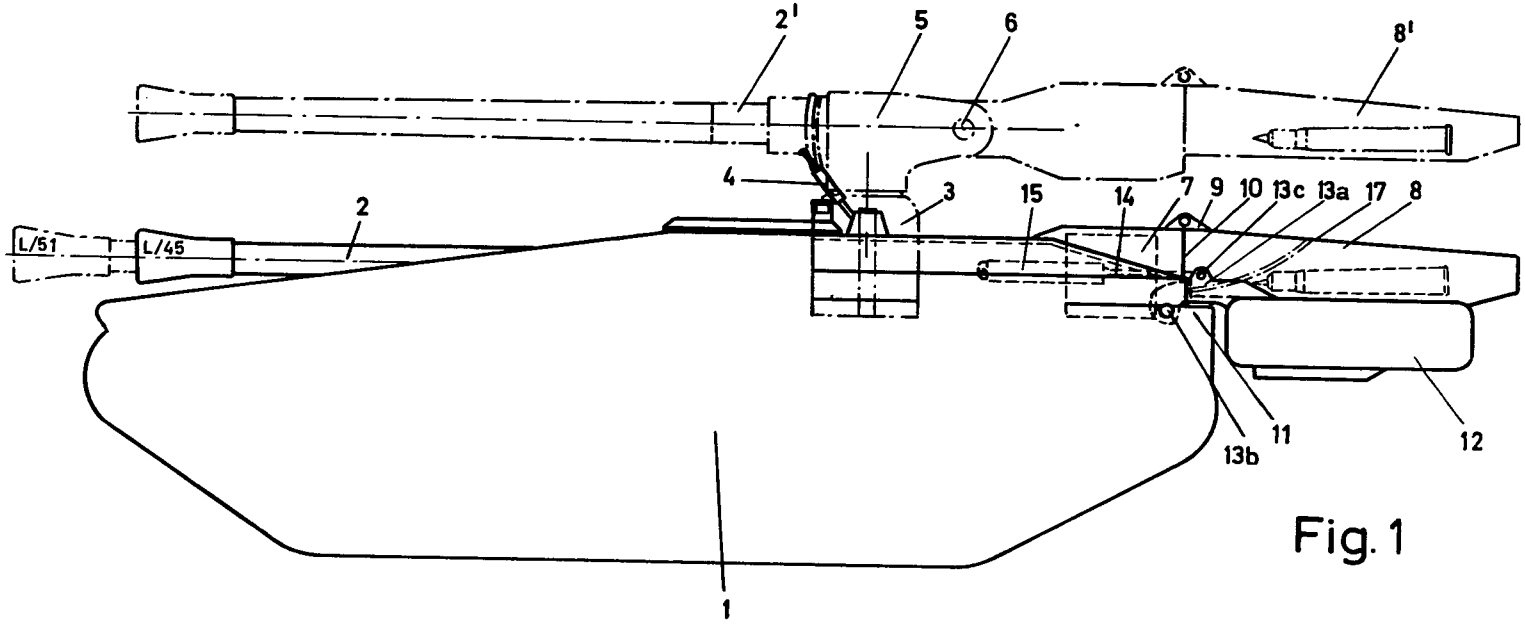
Figure 2:
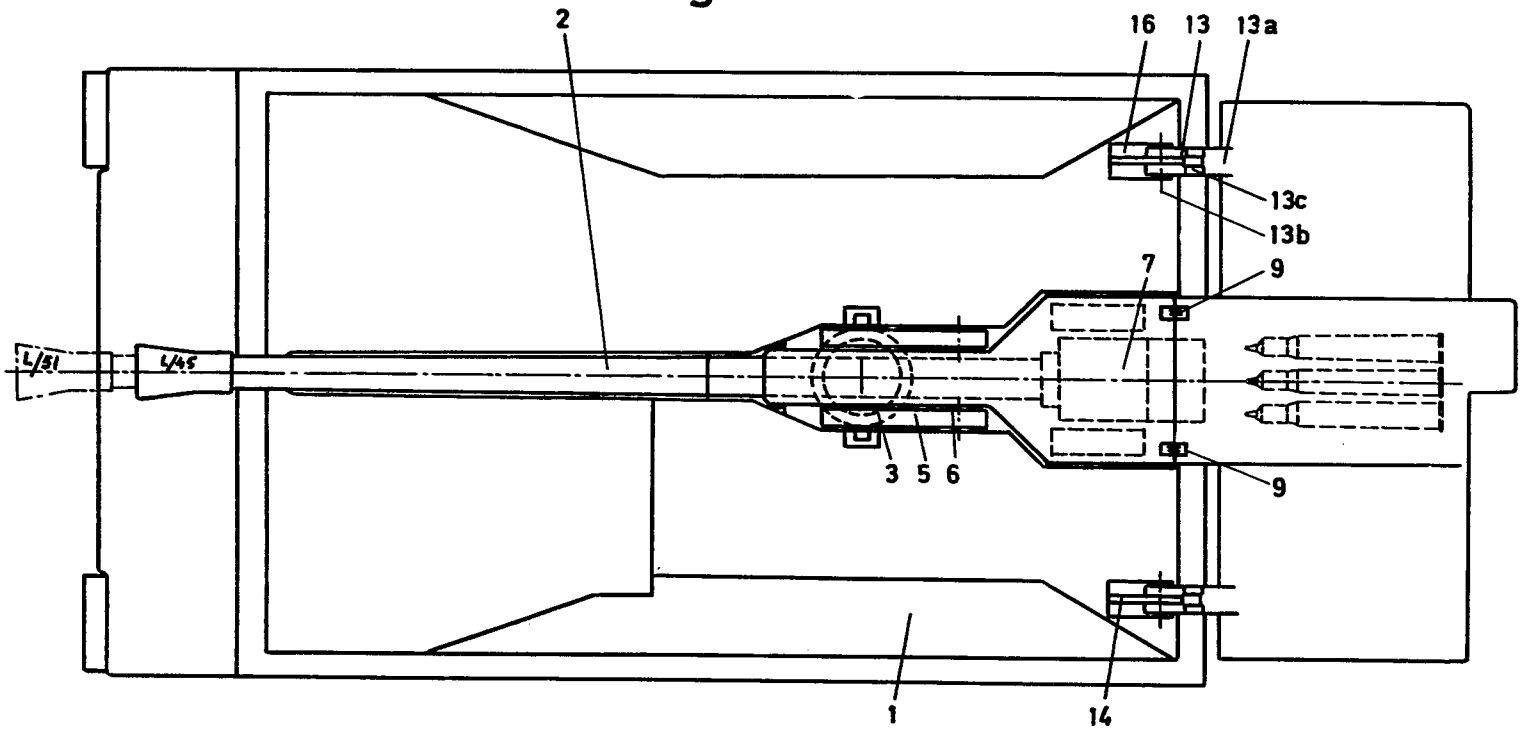

In FIGS. 1 and 2, a tank 1 is provided with a firearm 2. The tank is provided with which are wheels fastened to the tank chassis by levers which are arranged in a way known in the art so that the tank chassis can be elevated and depressed in relation to the ground. The firearm, which consists of a high-pressure gun 2 with a calibre of 105 mm, is arranged so that it can be raised and lowered in relation to the tank chassis, and the position indicated in FIG. 1 with solid lines indicates the lowered position and the position indicated with the dot-dash lines 2' the fully raised position of the gun. The raising and lowering devices are symbolized with the numeral 3. In the lowered position, the firearm is traversed by turning the entire tank. In this position, the gun is secured to the chassis with devices not shown in detail, in order to permit firing in the lowered position. Said securing devices can comprise, for instance, hydraulic cylinders arranged in the tank chassis, the pistons of which coact with corresponding recesses in, for instance, the recoil jacket of the firearm. Elevation of the firearm in the lowered position takes place by means of appropriate orientation the tank hull.

The firearm is supported pivotally in a way known in the art on the members 3 which can be raised and lowered in relation to the tank chassis, and the carrier part of the pivotal support in FIG. 2 is designated 5 and the trunnions which are located comparatively far to the rear on the carrier part are designated 6. The breech ring on the firearm is designated 7. The members 3 which can be raised and lowered are made, in accordance with what is stated below, so that the firearm in the fully raised position can be traversed in relation to the tank chassis. Because of the location of the pivotal support comparatively far to the rear on the tank, said breech ring, at its zero traversing position relative to the tank chassis, will be located substantially in line with the rear parts of the tank.

According to the invention, a first magazine portion 8 is arranged at the rear part of the firearm, the lowered position of being indicated in FIG. 1 with solid lines, and the raised position shown with dot-dash lines 8'. The first magazine portion is fastened to the firearm via two articulate fastening members in the form of hinges 9, which are located at the upper parts of the first magazine portion so that the magazine portion in question can be pivoted upwardly in relation to the firearm. The normal position of the magazine portion, as shown in FIG. 1, is that wherein the end edges of the magazine portion coact with corresponding edges of the firearm when the weight of the magazine portion presses this portion downwards around the hinge supports. The upward pivoting of the first magazine portion is at times required when the magazine would otherwise strike the ground such as when driving in reverse, driving over ditches and the like, elevating etc. The collapsible flotation screen of the tank is designated 11.

The magazine portion also comprises a second magazine 12 which is connected to the tank chassis. This magazine portion forms a member which is separate from the rest of the tank chassis, and is also fastened with articulate fastening devices 13 which, respectively, comprise an arm 13*a* set on edge and somewhat curved in the plane according to FIG. 1 and a supporting shaft 13*b*. The arm 13*a* has one of its ends rigidly fastened to the upper side of the second part magazine, and its other end is provided with a through hole, via which the arm is rotatably supported on shaft 13*b*. In its center part, the arm is provided with a forked holder 13*c* for a piston 14 in a hydraulic cylinder 15. The hydraulic cylinder is fixed to the tank chassis in a recess 16, which emerges upwards in the tank, and in which receives the curved arm 13*a* for coaction with the supporting shaft 13*b*. The forked holder and the hydraulic cylinder then have such positions in relation to each other that the second magazine portion is rotatable in relation to the tank chassis by means of said hydraulic cylinder 15. The hydraulic cylinder is also cntrolled in such a way that in the normal position (i.e. the position according to FIGS. 1 and 2) of the second magazine portion such portion is permitted to pivot upwardly in relation to the tank chassis if outer forces arise due to collisions with the ground when driving the tank in reverse, driving over ditches, elevation etc.

As will be noted from FIGS. 1 and 2, the second magazine portion is suspended entirely freely behind the tank chassis and likewise the major portion of the first part magazine extends outside the tank. The second magazine extends along the major portion of the width of the tank, while the first magazine portion extends only partly in this direction, having a width which is about one-third of the width of the second magazine. The articulate fastening members of the respective part magazines are located at the corners of the respective magazine portion. Each magazine portion has a height that permits it to contain two rounds placed one on top of the other vertically.

In the lowered position of the gun, the magazine portion can be joined together in a connected position where the magazines are connected internally with each other in such a way that an automatic transfer of rounds can take place from the second magazine portion to the first magazine portion, which can then be made to hold, for instance, five rounds.

The first magazine portion can also be separated from internal connection with the firearm by means of a cover 17 that can be swung up, and which in its swung-up position permits passage of rounds while in the swung-down position it serves as a cartridge case deflector for empty cartridge cases.

Figure 3:
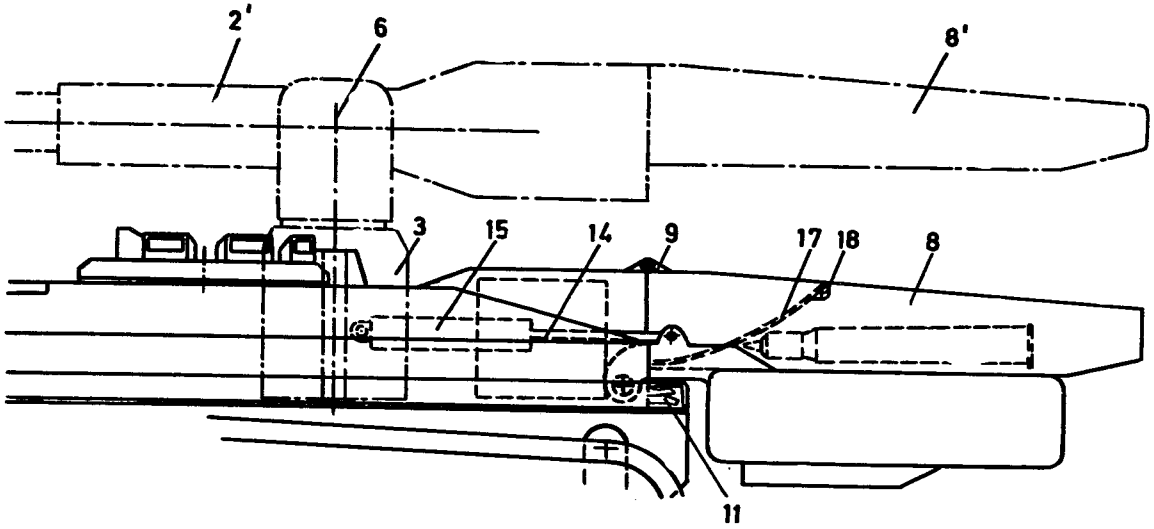
Figure 4:
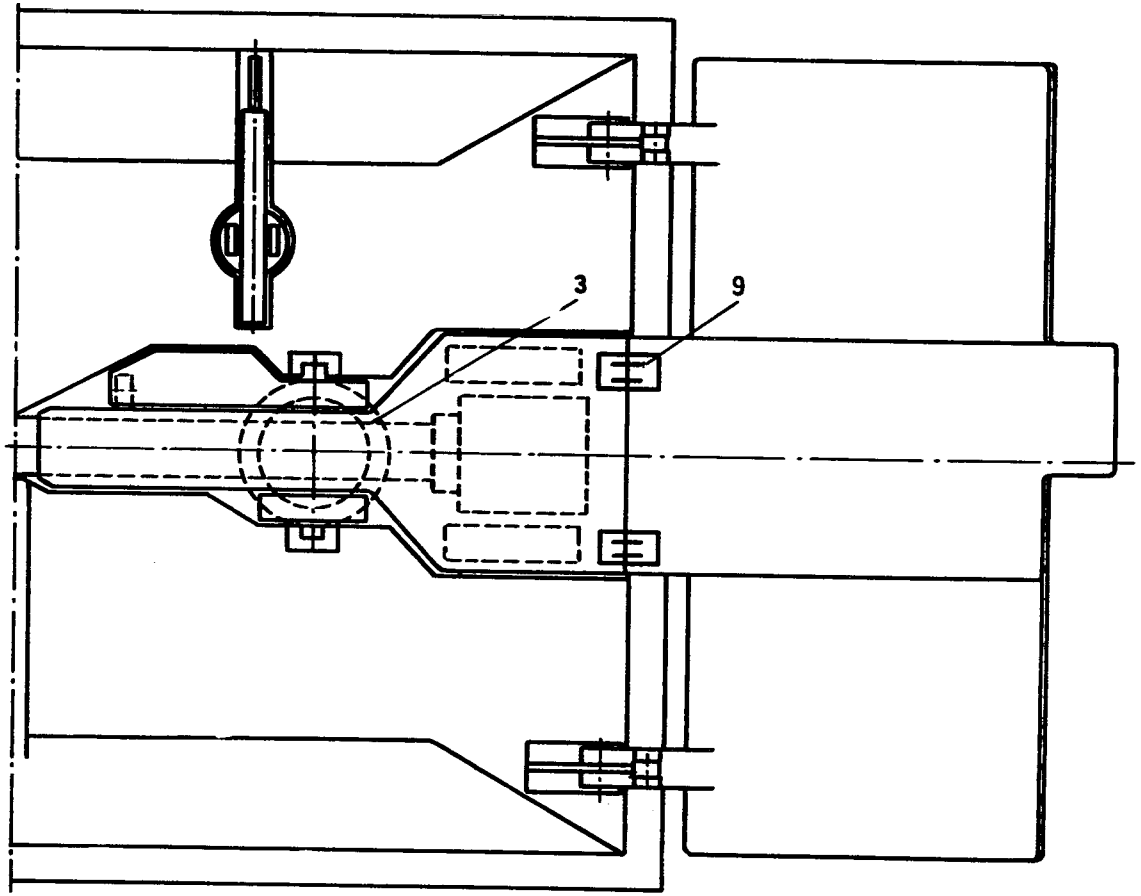

FIGS. 3 and 4 are intended to show the parts in quesion of a tank on which the firearm to a certain extent is supported differently on the members 3 that can be raised and lowered. In FIG. 3, the support for the cover 17 has been designated 18, and this support is located at the upper parts of the first magazine portion and can consist of conventional hinge joints. The control of this cover can be carried out with, for instance, the ramming devices of the firearm.

Figure 5:
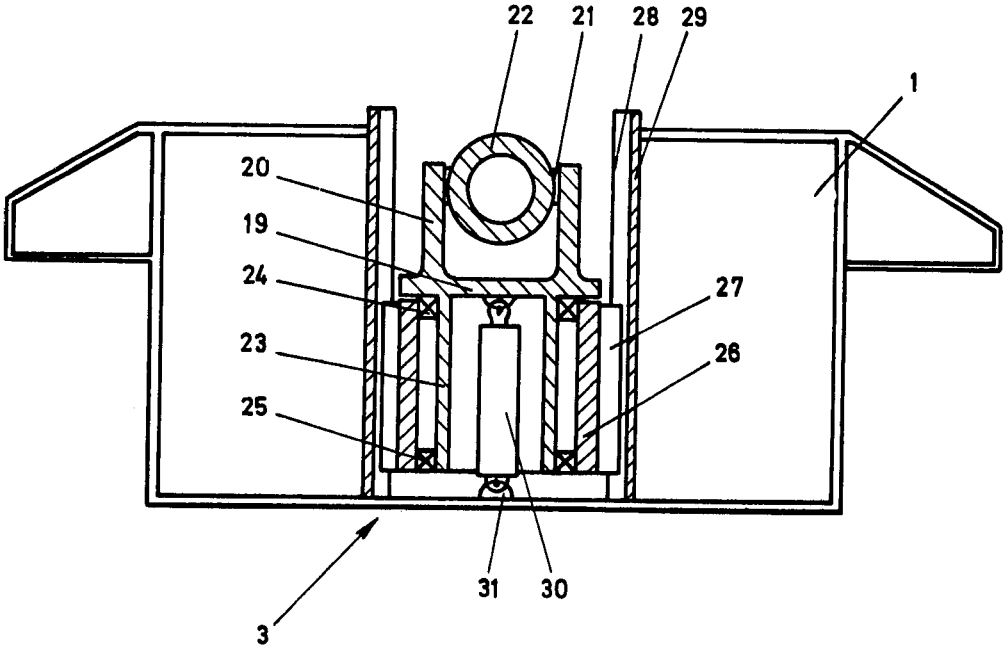

FIG. 5 shows how the members 3 can be raised and lowered. In this case, the gun is supported on a plate 19, in which the carrier part 20 of the pivotal support is mounted. The weapon is supported in the trunnions 21 in a way known in the art with the trunnion supporting the jacket of the barrel 22. The plate is arranged at the upper part of an inner cylinder 23, which is rotatably supported in the ball bearings 24 and 25 in an outer cylinder 26. The outer cylinder is made with guides 27 which run in vertical grooves 28 in guide rails 29 which are fixed to the chassis 1.

The movements in relation to the tank chassis of the members 3 are achieved by means of a hydraulic cylinder 30, which is fastened to the tank chassis at a fastening point 31 and at the under side of the plate 19.

Figure 6:
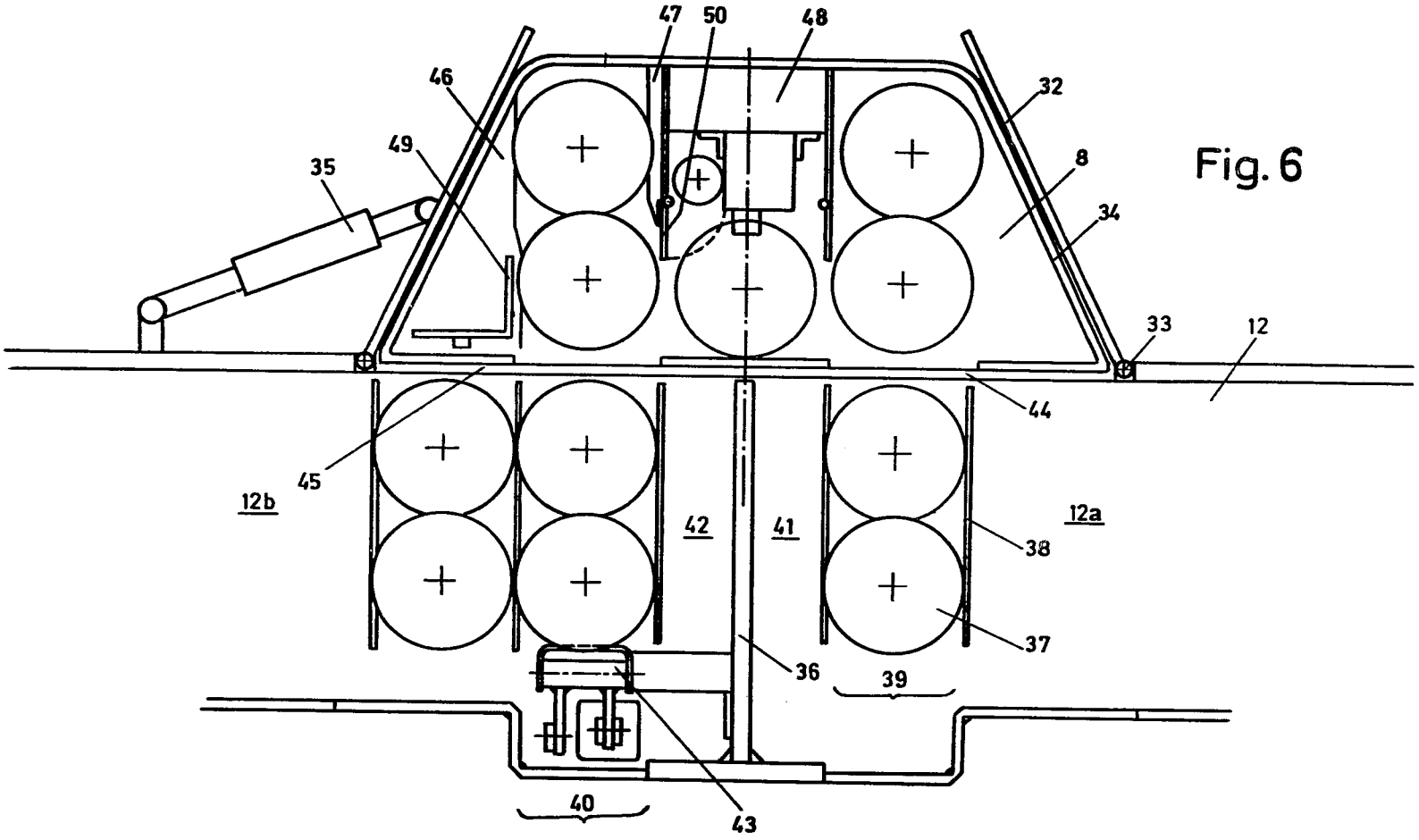

FIG. 6 shows the two magazine portions in a position where they are joined together, which is achieved with the aid of first covers 32, which are rotatably supported in the roof of the space defined by the second magazine portion. Said supporting means for the first covers extend in the transverse direction of the magazine portion, i.e. in a direction at right angles to the plane of FIG. 6. The first magazine portion is provided with side surfaces 34 inclined ouwardly from its upper parts, against which surfaces said covers 32 can be pressed so that the two magazine portions can be locked together. The movements of the first covers can be achieved by means of a hydraulic cylinder 35, turning of the supporting shafts in the supports 33, etc. The covers are rotatable between an entirely swung-up position in which the first magazine portion with its wider bottom can pass between the covers and come into contact with the roof of the second magazine portion, and an entirely closed position where the first covers serve as covers for one or several openings in the roof of the second magazine portion when the part magazine portions are in positions where they are separated from each other.

The second magazine portion is divided into two compartments 12*a* and 12*b*, by means of a separating wall 36. In the compartments, rounds 37 are inserted in two rows arranged one on top of the other, the rounds in the rows then being separated by means of separating walls 38, by means of which columns of two rounds are obtained. Said separating walls can be actuated by means of lateral feeding devices not shown in detail and which are known in the art, for transportation of the rounds into the second magazine portion. The compartments 12*a* and 12*b* each have a feed-out position 39 and 40, respectively, for the rounds, toward which other columns of rounds are thus fed as soon as the rounds in the feed-out position have been pressed up into the fixed compartment. As the feeding out progresses from the second magazine portion, the separating walls 38 ae collected in spaces 41 and 42, respectively, which are intended for this purpose.

The pressing up into the respective feeding positions takes place by means of hoisting members which are known in and via link arms which can be actuated by means of hydraulic cylinders at the bottom of the second magazine portion. The hoist device has three distinct positions, one of which, the rest position, is shown in FIG. 6. In an intermediate position, one of the two rounds of the column has been fed up, and at the end position, both rounds have been fed up.

Above the respective feed-up positions in the second magazine portion, there are feed-out openings 44 and 45, respectively. Via these feed-out openings, the magazine portions, when joined together, are connected internally with each other. Above the respective feed-up positions in the second magazine portion, the first magazine portion then has room for two rounds placed one on top of the other, and the two rounds in this position are guided in guide members 46 and 47. Between said two pairs of rounds there is also room for a fifth round in the first part magazine, above which members 48 for ramming of the fifth round are arranged. Said ramming members are arranged in a way which is known in the art, and in the cross-section shown, occupies a space which substantially corresponds to a sixth round.

For each of its pairs of rounds positioned beside each other, the first magazine portion is also provided with lateral displacement devices 49, which can be made in a way which is known in the art. In the case shown, the lateral displacement devices are made in the form of an angular part which extends straight in a direction at right angles of the plane of FIG. 6. The horizontal part of said angular part is supported on swinging arms, by means of which the angular part can be displaced laterally towards the place for said fifth round. The vertical part of the angular part coacts with the round which is to be displaced laterally, and then not only serves as a lateral displacing device, but also as a side support at the ramming. Blocking members 50 are also arranged at the support 47. Filling up of the first magazine portion can thus take place in such a way that a column of two rounds is first fed into the first magazine portion from either of the feed-up positions in the second magazine portion, and the lateral displacement device 49 which serves the column of rounds which has been fed up is then activated so that the lower round is moved to the place for the ramming position, i.e. the position for said fifth round, and is rammed by means of the ramming members 48. Thereafter, the lateral displacement device is actuated again, so that the remaining round in the pressed-up column of rounds is moved to said ramming position. Guiding and holding of the upper round in said column of rounds is then arranged so that the upper round does not fall down in the place of the lower round until the lateral displacement devices have reached the fetching position. Thereafter, a column of two rounds is fed up from the respective compartment in the second magazine. The gun can thereafter be actuated to its raised position, where six rounds can thus be fired before new feeding of rounds from the second magazine is required. When rounds are fired in the lowered position, pressing up can taken place continuously from one of the compartments or, alternatively, in an alternating manner, and in certain cases it can be an advantage to have the lateral displacement in the first magazine portion take place as soon as one of the two rounds in the column have been pressed up into such first magazine portion, the hoisting device then, during the time for the lateral displacement, retaining the remaining round in the column in its intermediate position by means of the embodiment shown, it is also possible to have a choice of ammunition if the two compartments in the second part magazine are loaded with rounds of different types.

In accordance with the above, the openings 44 and 45 can be covered with the first covers 32, while the corresponding openings in the bottom of the first magazine portion can be covered by means of other covers, not shown in detail. The invention is not limited to the embodiments shown above as examples, but can be subject to modifications within the scope of the following claims.

What we claim is:

1. In a tank, the combination comprising:

a large-caliber pivotable firearm and means for raising and lowering the pivot of the firearm relative to the tank chassis, a first magazine connected to the firearm at the rear end of the firearm and movable with movement of the firearm, a second magazine connected to the tank chassis and lying exteriorly of said chassis, and means for interconnecting said first and second magazines only when the firearm and first magazine are moved to a preselected position relative to the chassis and second magazine which brings said first and second magazines in close juxtaposition so as to permit the transfer of rounds of ammunition from said second magazine to said first magazine.

2. The combination of claim 1 in which said first magazine is pivotally connected to the firearm.

3. The combination of claim 1 in which said second magazine is pivotally connected to the chassis of the tank.

4. The combination of claim 1 in which said first magazine is pivotally connected to the firearm and said second magazine is pivotally connected to the tank chassis and is positioned to the rear and externally of the tank chassis.

5. The combination of claim 1 in which said first magazine comprises sidewalls which angle outwardly from an upper surface of said first magazine, said second magazine having a pair of rotatable covers which in closed position enclose the top portion of said second magazine, said covers being operable to an at least partially open position in which each lies against a respective angled sidewall of said first magazine.

6. The combination of claim 5 in which said covers in their closed position cover respective openings in said second magazine through which rounds of ammunition can be transferred to said first magazine.

7. The combination of claim 1 in which said second magazine includes a partition to divide said second magazine into two compartments, and hoisting means in each said compartment for transferring rounds from said second compartment to said first compartment.

8. The combination of claim 1 wherein said first magazine includes means for ramming a round into the firearm.

9. In a tank, the combination comprising:

a large-caliber pivotable firearm and means for raising and lowering the pivot of the firearm relative to the tank chassis, a first magazine connected to the firearm at the rear end of the firearm and movable with movement of the firearm, a second magazine pivotally connected to the tank chassis, and means for interconnecting said first and second magazines only when the firearm and first magazine are moved to a preselected position relative to the chassis and second magazine which brings said first and second magazines in close juxtaposition so as to permit the transfer of rounds of ammunition from said second magazine to said first magazine.

* * * * *